US008807337B2

(12) United States Patent
Barcik

(10) Patent No.: US 8,807,337 B2
(45) **Date of Patent: *Aug. 19, 2014**

(54) GOLF BAG

(71) Applicant: David H. Barcik, Highlands Ranch, CO (US)

(72) Inventor: David H. Barcik, Highlands Ranch, CO (US)

(73) Assignee: BarSix, LLC, Highlands Ranch, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/708,765

(22) Filed: Dec. 7, 2012

(65) Prior Publication Data

US 2013/0092575 A1 Apr. 18, 2013

Related U.S. Application Data

(63) Continuation-in-part of application No. 13/241,672, filed on Sep. 23, 2011, now Pat. No. 8,534,458.

(51) Int. Cl.
*A63B 55/00* (2006.01)
*A63B 55/04* (2006.01)

(52) U.S. Cl.
CPC ..... *A63B 55/00* (2013.01); *A63B 55/04* (2013.01); *A63B 2210/50* (2013.01); *A63B 55/045* (2013.01)
USPC ..... 206/315.8; 206/315.1; 206/315.2; 206/315.3; 220/9.2; 220/9.4; 383/104; 383/36; 248/163.1; 248/588; 248/94

(58) Field of Classification Search
CPC .... A63B 55/00; A63B 55/04; A63B 2210/50; A63B 55/004; A63B 55/045
USPC ..... 206/315.1, 315.2, 315.3, 315.8; 220/9.2, 9.4; 248/163.1, 588, 94; 383/104, 36
See application file for complete search history.

(56) References Cited

U.S. PATENT DOCUMENTS

| | | | | | |
|---|---|---|---|---|---|
| 858,488 | A | * | 7/1907 | Tyner | 220/9.2 |
| 1,086,002 | A | | 2/1914 | Stewart | |
| 1,647,679 | A | * | 11/1927 | Williams | 220/9.2 |
| 2,091,298 | A | * | 8/1937 | Agnew | 206/315.2 |
| 2,435,479 | A | * | 2/1948 | Thommen | 206/315.8 |
| 3,410,328 | A | * | 11/1968 | Sasai | 220/9.2 |
| 3,448,748 | A | * | 6/1969 | Walrave | 135/127 |
| 4,181,167 | A | | 1/1980 | Ret | |
| 4,266,589 | A | | 5/1981 | Cochran | |
| 4,319,616 | A | | 3/1982 | Light | |

(Continued)

*Primary Examiner* — Fenn Mathew
*Assistant Examiner* — Cynthia Collado
(74) *Attorney, Agent, or Firm* — Kilpatrick Townsend & Stockton LLP

(57) ABSTRACT

According to the invention, a golf bag is disclosed. The golf bag may include a frame and a removable cover. The frame may include a top member at a top most portion of the frame, and a bottom member at a bottom most portion of the frame. The removable cover may include a central portion, a first coupling member, and a second coupling member. The first coupling member may be coupled with at least a portion of a top of the central portion. The second coupling member may be coupled with at least a portion of a bottom of the central portion. The first coupling member may be reversibly coupled with a top most portion of the top member. The second coupling member may be reversibly coupled with a bottom most portion of the bottom member.

20 Claims, 8 Drawing Sheets

(56) References Cited

U.S. PATENT DOCUMENTS

| | | | | |
|---|---|---|---|---|
| 4,350,194 | A | 9/1982 | Brown | |
| 4,378,039 | A * | 3/1983 | Suk | 206/315.8 |
| 5,183,226 | A | 2/1993 | Brooks | |
| 5,476,050 | A * | 12/1995 | Zimmer et al. | 108/145 |
| 5,482,160 | A * | 1/1996 | Perrin | 206/315.8 |
| 5,899,328 | A | 5/1999 | Dulyea, Sr. | |
| 5,941,383 | A * | 8/1999 | Cheng | 206/315.8 |
| 6,113,188 | A * | 9/2000 | Stewart et al. | 297/339 |
| 6,276,548 | B1 * | 8/2001 | Mitchell | 220/9.4 |
| 6,315,143 | B1 | 11/2001 | Dotts | |
| 6,330,944 | B1 | 12/2001 | DeMichele | |
| 6,427,607 | B1 | 8/2002 | Palmer | |
| 6,478,151 | B1 | 11/2002 | Schmidt et al. | |
| 6,510,944 | B2 | 1/2003 | Chang | |
| 6,749,062 | B1 | 6/2004 | Meissner | |
| 6,758,334 | B2 | 7/2004 | Uner et al. | |
| 6,935,496 | B2 | 8/2005 | Chang et al. | |
| 7,059,470 | B2 | 6/2006 | Slankster | |
| 7,246,784 | B1 | 7/2007 | Lopez | |
| 7,387,084 | B2 | 6/2008 | Hildenbrand et al. | |
| 7,526,997 | B2 | 5/2009 | Davidson | |
| 7,743,916 | B2 | 6/2010 | Roberts, II | |
| 7,815,372 | B2 | 10/2010 | Stanton et al. | |
| 8,141,705 | B2 | 3/2012 | Aubery et al. | |
| 2003/0015634 | A1 | 1/2003 | Yoon | |
| 2003/0094390 | A1 | 5/2003 | Thompson et al. | |
| 2003/0230503 | A1 | 12/2003 | Borrelli | |
| 2005/0040059 | A1 | 2/2005 | Herold | |
| 2006/0272967 | A1 | 12/2006 | Bremner | |
| 2010/0051489 | A1 | 3/2010 | Shiao | |
| 2013/0075291 | A1 | 3/2013 | Barcik | |

* cited by examiner

GOLF BAG

CROSS REFERENCES TO RELATED APPLICATIONS

This application claims priority to, and is a continuation-in-part of, U.S. patent application Ser. No. 13/241,672, filed Sep. 23, 2011, entitled "GOLF BAG," the entire disclosure of which is hereby incorporated by reference, for all purposes, as if fully set forth herein.

BACKGROUND OF THE INVENTION

The invention relates generally to golf bags. More specifically, the invention relates to golf bags having removable outer skins and/or lightweight rigid structures.

Golf bags known in the art suffer from numerous deficiencies. Often these golf bags do not offer the ability to customize their outward appearance. Even those golf bags which are somewhat customizable do so only in cumbersome ways, while also potentially undermining the structural rigidity of the golf bag.

Furthermore, while some golf bags are lightweight, it is usually at the expense of soundness of the structural integrity of the golf bag. Meanwhile, other golf bags which do offer a sturdy structure often do so at the undesirable expense of increasing the overall weight of the golf bag.

Embodiments of the instant invention provide solutions to these and other problems.

BRIEF DESCRIPTION OF THE INVENTION

In one embodiment, a golf bag is provided. The golf bag may include a frame and a removable cover. The frame may include a bottom member, a top member, four diagonal members, a longitudinal member, and a frame coupling element. Each of the four diagonal members may diagonally couple the bottom member with the top member. The longitudinal member may longitudinally couple the bottom member with the top member. The frame coupling element may couple two of the diagonal members and the longitudinal member. The longitudinal member may include a carrying handle protruding from a first surface of the longitudinal member. The removable cover may include a central portion, a first coupling member, and a second coupling member. The first coupling member may be coupled with at least a portion of a top of the central portion. The second coupling member may be coupled with at least a portion of a bottom of the central portion. The first coupling member may be reversibly coupled with the top member. The second coupling member may be reversibly coupled with the bottom member. The central portion may be flexible such that when the first coupling member is coupled with the top member, and the second coupling member is coupled with the bottom member, the central portion may be in tension.

In another embodiment, a golf bag is provided. The golf bag may include a frame and a removable cover. The frame may include a top member at a top most portion of the frame, and a bottom member at a bottom most portion of the frame. The removable cover may include a central portion, a first coupling member, and a second coupling member. The first coupling member may be coupled with at least a portion of a top of the central portion. The second coupling member may be coupled with at least a portion of a bottom of the central portion. The first coupling member may be reversibly coupled with a top most portion of the top member. The second coupling member may be reversibly coupled with a bottom most portion of the bottom member.

In another embodiment, a golf bag is provided. The golf bag may include a frame and a cover. The frame may include a bottom member, a top member, four diagonal members, a longitudinal member, and a frame coupling element. Each of the four diagonal members may diagonally couple the bottom member with the top member. The longitudinal member may longitudinally couple the bottom member with the top member. The frame coupling element may couple two of the diagonal members and the longitudinal member. The cover may be disposed over the frame.

BRIEF DESCRIPTION OF THE DRAWINGS

The present invention is described in conjunction with the appended figures.

Figure 1:
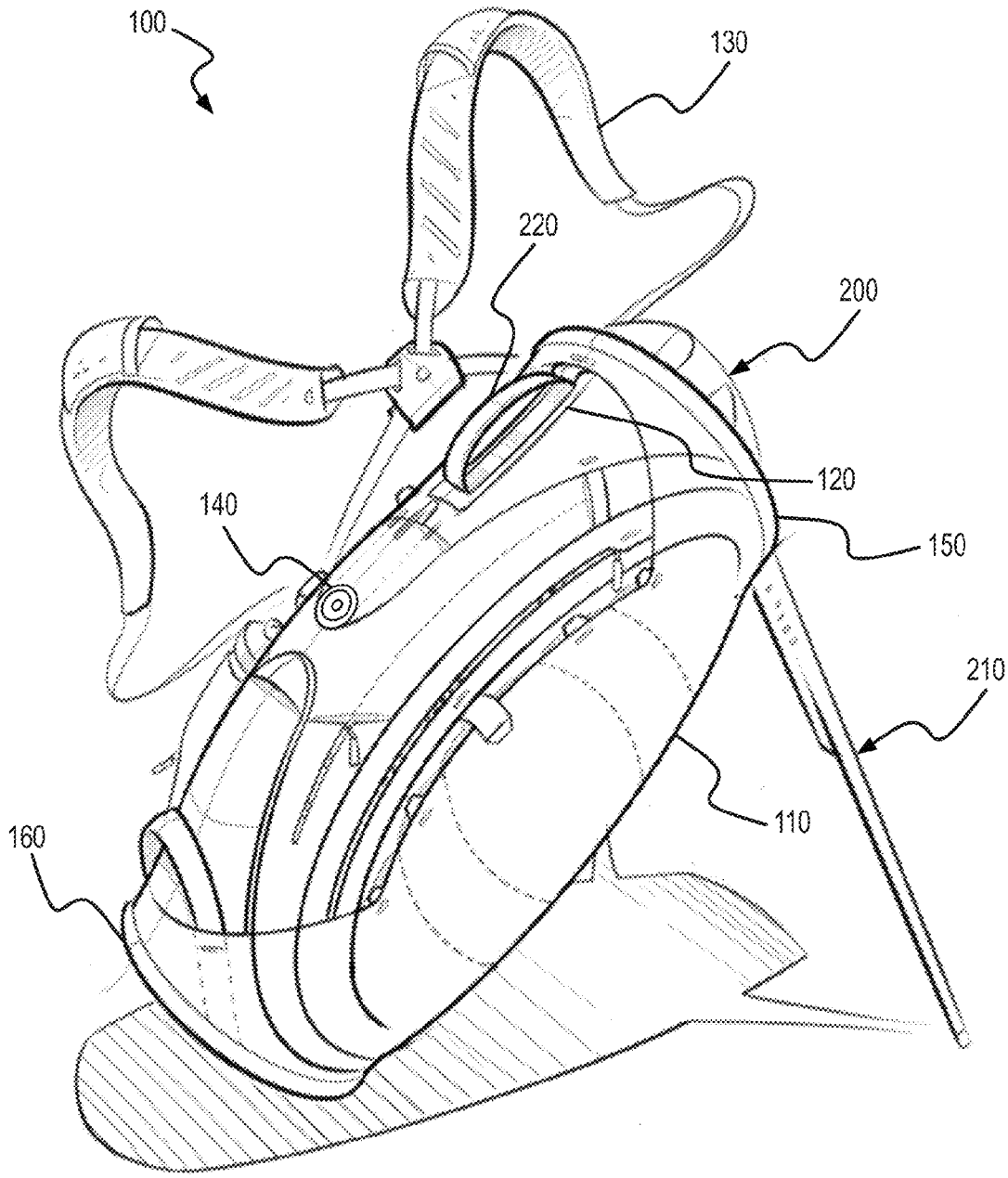
FIG. 1 is an axonometric view of one golf bag of the invention.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, well-known structures and mechanisms may be shown without unnecessary detail in order to avoid obscuring a complete understanding of the various possible embodiments. Additionally, any one or more specific details related in regards to one embodiment may be employed in any other embodiment discussed herein.

In one embodiment of the invention, a golf bag is provided. The golf bag may include a frame and a removable cover. In some embodiments, the golf bag may also include a carrying strap, shoulder harness, and/or deployable leg mechanism. An interior club separator may also be included.

In some embodiments, the frame may include a bottom member, a top member, four diagonal members, a longitudinal member, and a frame coupling element.

The top member may be a circular ring shaped element, being open so as to allow golf clubs and other items to be inserted into the golf bag. In some embodiments, the interior club separator may be at least partially disposed within the open area of the circular ring shaped element, and proceed further into the frame of the golf bag. The bottom member may be a closed circular element which prevents golf clubs and other items from falling from the bottom of the golf bag. The top and bottom members may be made from any number of possible materials, for example, polymers and/or metals.

Each of the four diagonal members may diagonally couple the bottom member with the top member. One or more of the diagonal members may be a member having a circular cross section. In these or other embodiments, the diagonal direction of the diagonal members may be characterized by a helical, spiral, and/or corkscrew direction around the circumference and height of the frame. In an exemplary embodiment, the frame may have two pairs of diagonal members, with each pair diagonally crossing each other near or at a mid level height of the frame. The diagonal members may be made from any number of possible materials, for example, polymers, composites such as fiberglass and fiber-reinforced plastic, and/or metals.

The longitudinal member may longitudinally couple the bottom member with the top member. The longitudinal member may couple perpendicularly with the top and bottom members (as opposed to the diagonal coupling of the diagonal members). The longitudinal member may include a carrying handle protruding from a first surface of the longitudinal member, toward the outside of the frame. The longitudinal member may have a rectangular cross section and/or be made from any number of possible materials, for example, polymers and/or metals.

In some embodiments, a frame coupling element may couple two of the diagonal members and the longitudinal member. In these or other embodiments, the frame coupling element may couple two of the diagonal members on a second side of the longitudinal member, where the second side is opposite the first side where the carrying handle is located. The frame coupling element may be made from one, two, or more individual pieces, and/or be made from any number of possible materials, for example, polymers and/or metals. Merely by way of example, the frame coupling element could consist of two pieces (for example, front and back pieces), where the longitudinal member and two of the diagonal members are disposed between the two pieces, with the two pieces being coupled together thereafter (for example, with screws, adhesive, etc.).

The removable cover may include a central portion, a first coupling member, and a second coupling member. The first coupling member may be located along at least a portion of the top of the central portion. The second coupling member may be located along at least a portion of the bottom of the central portion. The first and second coupling members may be made from any number of possible materials, for example, polymers and/or metals, and the central portion may be made from a differing material. For example, the central portion of the removable cover could be made from a natural or synthetic fabric, and could be composed of multiple pieces, all stitched, or otherwise joined together. Though not discussed in detail herein, the outside of the removable cover could have any number of pockets, fasteners, and compartments already known in the art.

Additionally, in some embodiments, the central portion of the removable cover may be made, at least partially, from a material which is more flexible in a first direction between the top member and the bottom member than a second direction perpendicular to the first direction. Thus, the removable cover would flex in the top-to-bottom direction of the golf bag when coupled with the frame (the removable cover, or some portion thereof, would be in tension). In these or other embodiments, when the removable cover is coupled with the frame at least a portion of the four diagonal members push outward on the removable cover from an interior of the golf bag. The removable cover, in particular the central portion, may either be non-flexible, or less flexible in the circumferential direction around the golf bag (perpendicular to the top-to-bottom direction).

In some embodiments, the first coupling member of the removable cover may be reversibly coupled with the top member, and the second coupling member of the removable cover may be reversibly coupled with the bottom member. "Reversibly coupled" means that a user of the golf bag could uncouple and re-couple the coupling members with the top and bottom members, in many embodiments without the aid of tools or other devices.

Various possible coupling mechanisms may be employed to couple the coupling members with the top and bottom members of the frame. In some embodiments, each of the first and second coupling members may include a hook shaped edge member, and each of the top member and bottom member may define a channel. In these embodiments, the first or second coupling member being reversibly coupled with the top or bottom member may result in the respective hooked shaped edge member being at least partially disposed within the respective channel.

In a similar embodiment, either one of the hook shaped members may have a barbed end (similar to a fish hook), living hinge, or a bulbous end. Likewise, the channels in the top and bottom members which accept these hook shaped members may have matching or congruently shaped channels to facilitate an interference fit of the coupling member with the frame element. In any embodiment, the hook shaped, or other shaped members, may either be inserted directly into the face of the channel, or inserted laterally at an entrance point at an end or intermediate point of the channel. The coupling member may then be run down the length of the channel (around the circumference of the top or bottom member), until the coupling member is completely disposed in the channel, end to end.

In yet other embodiments, any type of coupling mechanisms may be employed to couple the removable cover with the frame such that the removable cover completely covers the sides of the frame from view. Merely by way of example, buttons, rivet buttons, latches, hook and loop (Velcro®), string ties, buckles, magnets, zippers, etc. may be used at either one or both of the top and bottom of the removable cover to couple such to the frame. In this manner, the frame is fully protected on its side by the removable cover, and the removable cover advantageously aesthetically covers the entire side of the frame. Thus, removable covers can allow for different outer utility configurations and/or appearance of the golf bag.

In some embodiments, the golf bag may also include a carrying strap. A first portion of the carrying strap may be coupled directly or indirectly with the top member, and a second portion of the carrying strap may be reversibly coupled, directly or indirectly, with the frame coupling element. The carrying strap may either be a single purpose or dual purpose single-shoulder carrying strap and/or dual-shoulder harness. In some embodiments, the removable cover of the golf bag may have one or more cut-outs or apertures to allow the carrying strap to couple to the frame through the removable cover. In an exemplary embodiment, each end of the carrying strap will couple with the frame. In other embodiments however, one or both ends of the carrying strap may couple with the removable cover.

Any reversible coupling of the carrying strap with the frame may allow a user of the golf bag to quickly and easily uncouple the carrying strap with the frame. In this manner, the bottom of the carrying strap, which is likely to be coupled with the frame through an aperture in the removable cover, may be at least temporarily disconnected so that the removable cover can be uncoupled from the frame. The same or other removable cover could then be coupled with the frame, the carrying strap re-coupled, and the golf bag ready for use.

In another embodiment of the invention, a different golf bag is provided. The golf bag may include a frame and a removable cover. The frame may include a top member at a top most portion of the frame, and a bottom member at a bottom most portion of the frame. The removable cover may include a central portion, a first coupling member, and a second coupling member. The first coupling member may be coupled with at least a portion of a top of the central portion. The second coupling member may be coupled with at least a portion of a bottom of the central portion. The first coupling member may be reversibly coupled with a top most portion of the top member. The second coupling member may be reversibly coupled with a bottom most portion of the bottom member.

In some of these embodiments, the golf bag may also include a carrying strap. In these or other embodiments, the frame may further include a frame coupling element. A first portion of the carrying strap may be coupled with the top member of the frame, and a second portion of the carrying strap may be reversibly coupled with the frame coupling element. In some embodiments, the removable cover defines an aperture which allows the frame coupling element to be reversibly coupled with the second portion of the carrying strap through the aperture.

In some embodiments, the first coupling member may be a hook shaped edge member, and the top member may define a congruently shaped channel for reception and disposition of the first hook shaped edge member. Likewise, the second coupling member may also be a hook shaped edge member, and the bottom member may define a congruently shaped channel for reception and disposition of the second hook shaped member. In some embodiments, the central portion may at least partially be made from a material which is more flexible in a first direction between the top member and the bottom member than a second direction perpendicular to the first direction.

In another embodiment of the invention, a yet different golf bag is provided. The golf bag may include a frame and a cover. The frame may include a bottom member, a top member, four diagonal members, a longitudinal member, and a frame coupling element. Each of the four diagonal members may diagonally couple the bottom member with the top member. The longitudinal member may longitudinally couple the bottom member with the top member. The frame coupling element may couple two of the diagonal members and the longitudinal member. The cover may be disposed over the frame. In some embodiments, the cover may be reversibly coupled with the frame. In these or other embodiments, the cover may be coupled with both the top member and bottom member of the frame, and stretched there-between.

Turning now to FIG. 1, an axonometric view of one golf bag 100 of the invention is shown. Golf bag 100 may include a frame 200 (see FIG. 2) and a removable cover 110 disposed over frame 200. Deployable leg stands 210 are also shown. Carrying handle 220 may protrude from frame 200 and through a first aperture in removable cover 220.

Carrying strap 130 may be coupled at one end with frame 200 at any point near the top of frame 200. In other embodiments, not shown here, carrying strap 130 may couple with the frame through aperture 120, or another aperture through removable cover 110. Aperture 140 provides an access point through removable cover 110 to allow attachment of the other end of carrying strap 130 to frame 200 (carrying strap 130 shown not attached to frame 200 in FIG. 1). As can be seen from FIG. 1, removable cover 110 covers the entirety of the sides of golf bag 100, with the top and bottom of the removable cover having coupling elements 150, 160 to reversibly couple removable cover 110 to the top-most and bottom-most portions of frame 200.

Figure 2:
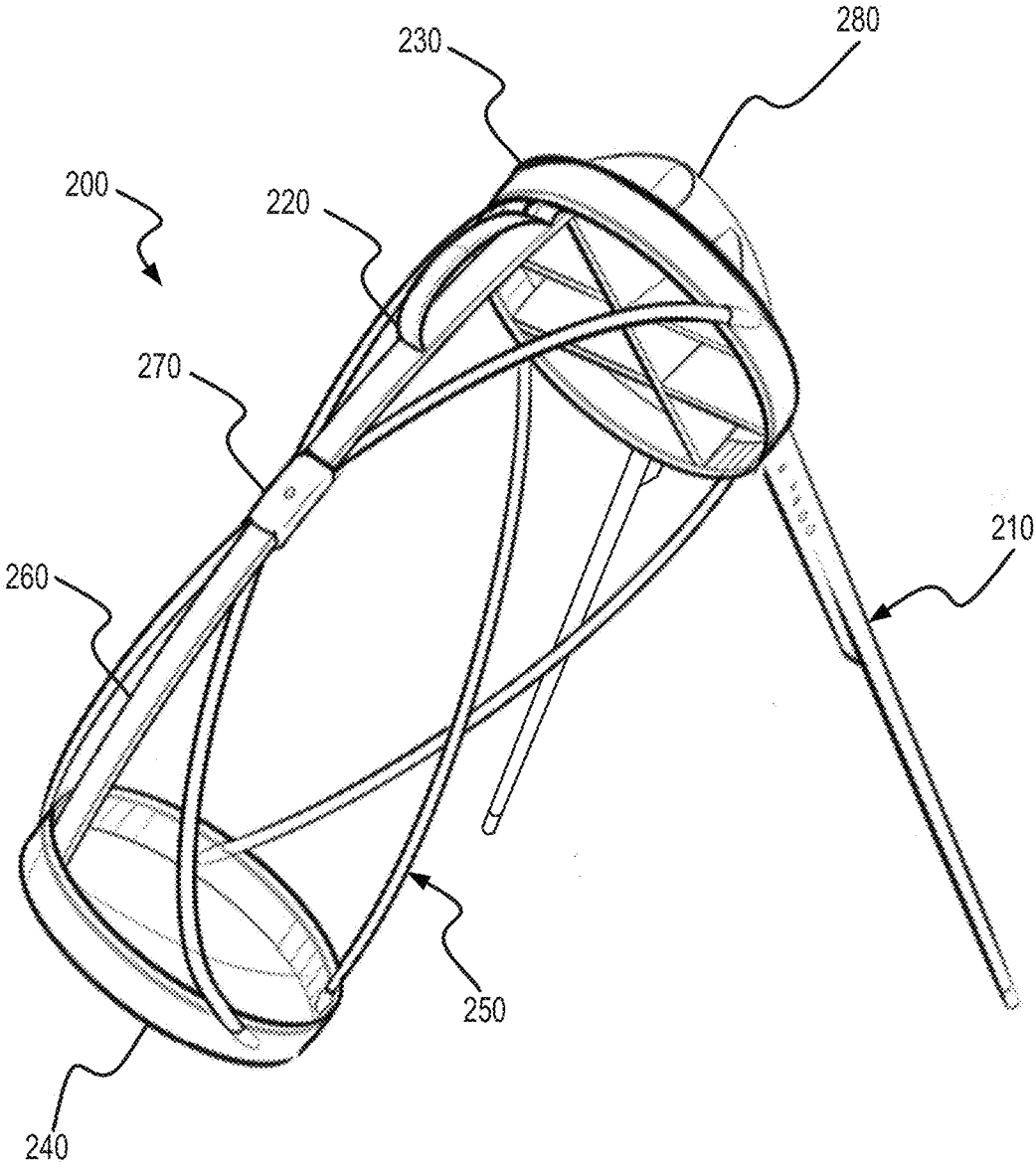
FIG. 2 is an axonometric view of one frame of a golf bag of the invention.

FIG. 2 shows an axonometric view of the frame 200 of golf bag 100 from FIG. 1. Frame 200 includes deployable leg stands 210, carrying handle 220, top member 230, bottom member 240, diagonal members 250, longitudinal member 260, frame coupling element 270, and club separator 280.

As described above, diagonal members 250 diagonally couple top member 230 with bottom member 240. Diagonal members 250 may couple in to cylindrical recesses in top member 230 and bottom member 240. Two of diagonal members 250 cross each other and are coupled together by frame coupling element 270, which also coupled with longitudinal member 260. Frame coupling element 270 may be the connection point for the bottom of carrying strap 130. Longitudinal member 260 may couple with rectangular shaped recesses in top member 230 and bottom member 240. Additional fasteners or adhesives may also be used at any coupling described herein. Furthermore, club separator 280 and deployable leg stands 210 may be fixedly coupled with, or integral to, top member 230.

Figure 3:
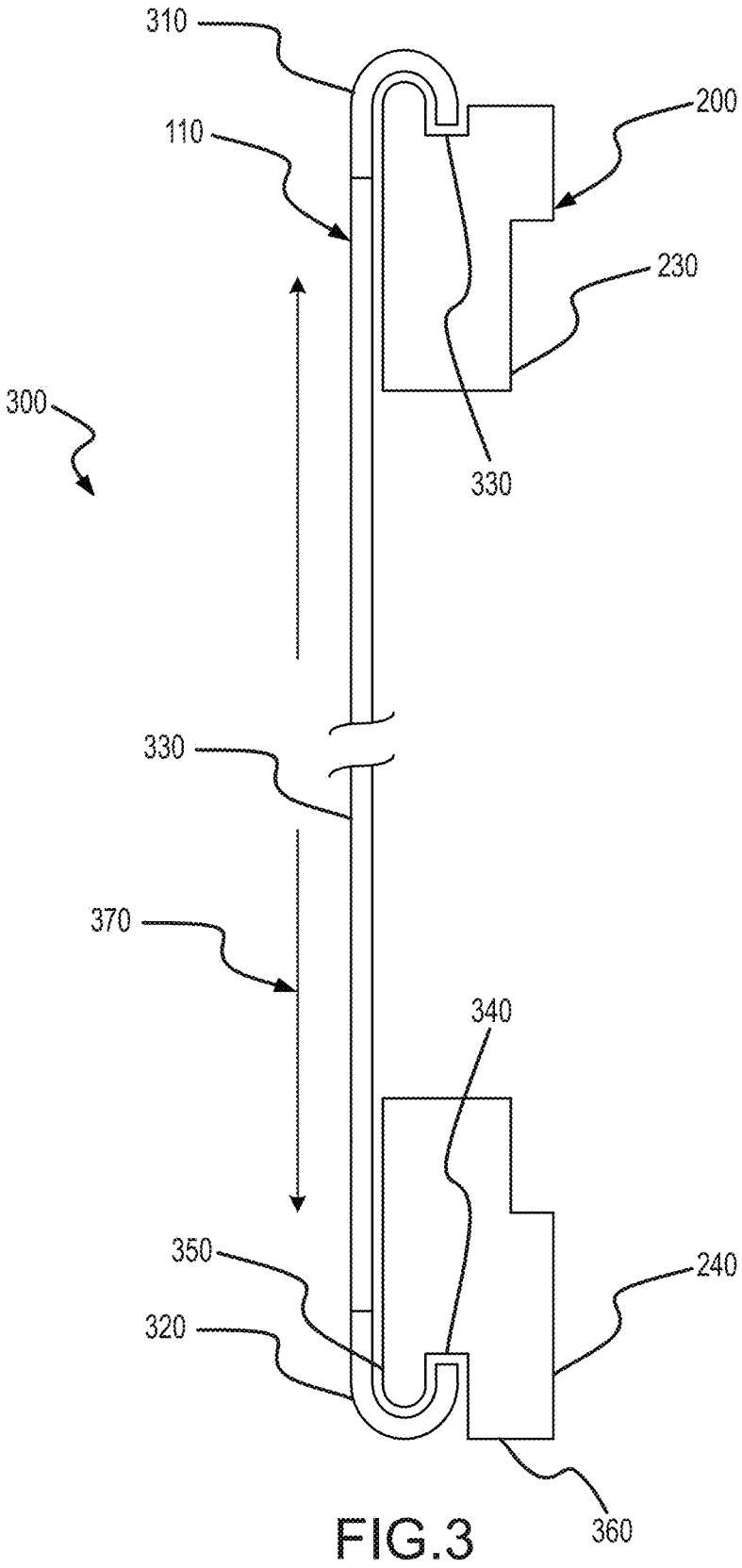
FIG. 3 is a sectioned side view of one cover-to-frame attachment system of the invention.

FIG. 3 shows a sectioned side view of one removable cover 110 to frame 200 attachment system 300 of the invention. Removable cover 110 may include a top coupling member 310, and a bottom coupling member 320. These coupling members 310, 320 may be fixedly coupled with, or integral to, central portion 330 of removable cover 110.

Frame 200 may include top member 230 and bottom member 240. Top coupling member 310 may include a hook shaped element which is deposited into a channel 330 on top member 230. In this manner, the top of removable cover 110 covers the entirety of the outside portion of frame 200 at the top member 230, so that none of top member 230 is viewable from the outside of golf bag 100.

Bottom coupling member 320 may also include a hook shaped element which is deposited into a channel 340 on bottom member 240. In this manner, the bottom of removable cover 110 covers the entirety of the outside portion of frame 200 at the bottom member 240, so that none of bottom member 240 is viewable from the outside of golf bag 100.

Note that channel 340 and its corresponding outer wall 350 is more recessed vertically than the corresponding channel 330 on top member 230. In this manner, removable cover 110 is less likely to be damaged with contact with the ground or other surfaces when being moved about. Instead, bottom 360 of bottom member 240 bears the brunt of any such impact. This may be advantageous because bottom member 240 may be constructed more robustly than bottom coupling member 320. Channels 330, 340 can be more or less recessed than shown, or can possibly be flush with their respective top and bottom members 230, 240 (as with top member 240).

In practice, to attach removable cover 110 with frame 200, top coupling member 310 may be coupled with top member 230, and then removable cover 110 may be stretched such that bottom coupling member 320 may be coupled with bottom member 240. In this manner, central portion 330 may be in tension between the top and bottom members 230, 240 as shown by directional arrows 370. This tensional force may at least partially assist in keeping removable cover 110 statically attached to frame 200. As discussed above, additional assistance in keeping removable cover 110 coupled with frame 200 may be realized by the use of different coupling mechanisms at top and bottom members 230, 240, as well as matching coupling mechanisms at top and bottom coupling members 310, 320.

Figure 4:
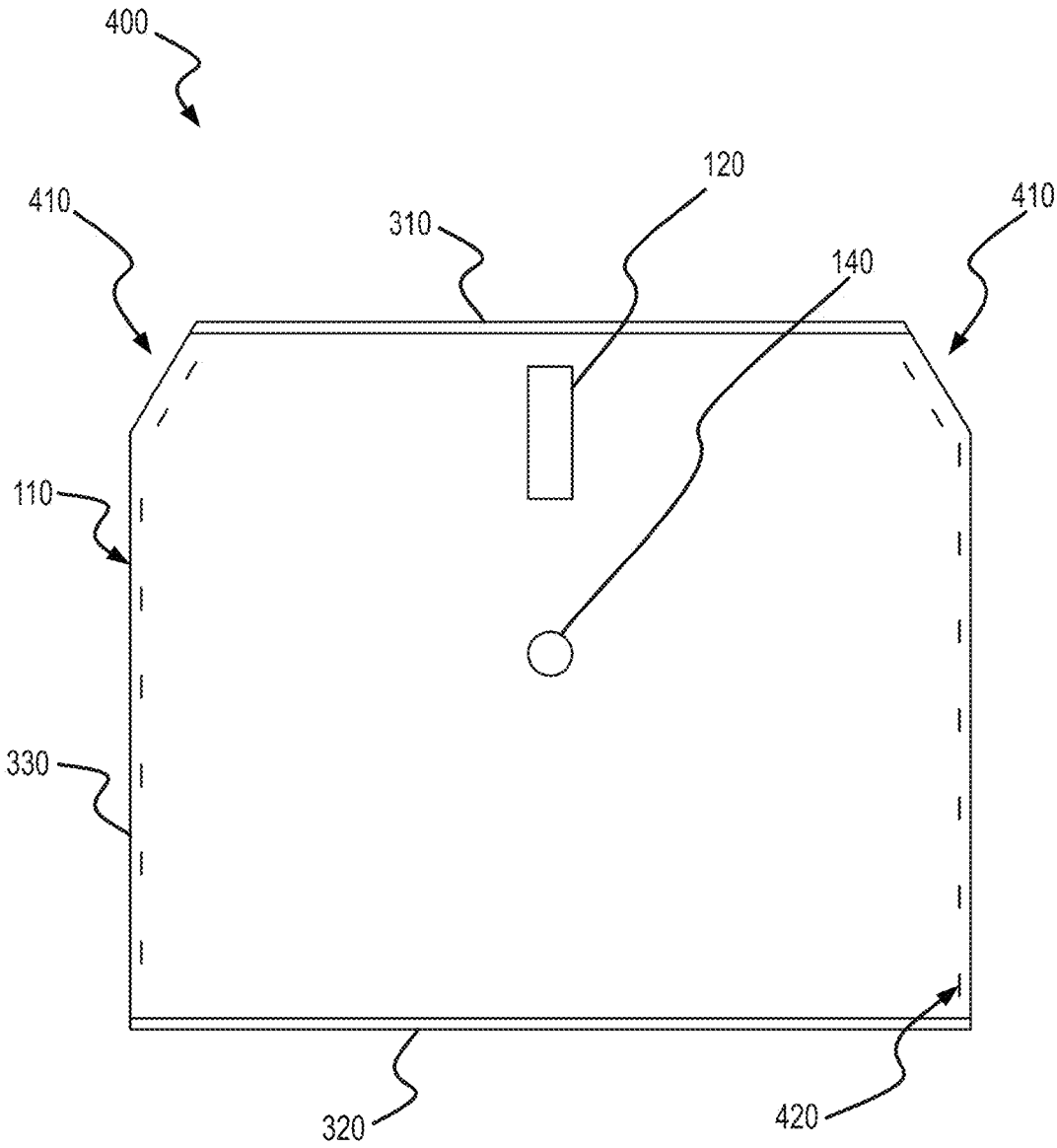
FIG. 4 is a plan view of one removable cover of the invention.

FIG. 4 shows a plan view 400 of one removable cover 110 of the invention. In this embodiment, top coupling element 310 and bottom coupling element 320 are shown coupled with central portion 330. Central portion 330 has two apertures, a first aperture 120 for the carrying handle to pass through, and a second aperture 140 for carrying strap 130 to be coupled with frame 200. In some embodiments, first aperture 120 may extend to and through the top of removable cover 110. In these embodiments, carrying strap 130 may couple with the frame through first aperture 120.

Removable cover 110 may have cut-outs 410 at the corners of removable cover 110 to allow for deployable leg stands to join with frame 200 at that location when removable cover 110 is coupled with frame 200. Likewise, cut-outs may also be provided in other embodiments at the bottom of removable cover 110, either to prevent damage to the bottom of removable cover 110 when golf bag 100 is deployed on its stand legs, or to allow for the operation of any mechanism which facilitates deployment of stand legs (ground pedal which actuates stand legs).

In the above described embodiment, the sides of top member 230 and bottom member 240 may be entirely obscured by removable cover 110, except portions of top member 230 and bottom member 240 which are integrated with, or attached directly to, leg/stand deployment mechanisms (and thus possibly visible through cut-outs 410). This may be accomplished because the coupling points for removable cover 110 are at the very top of top member 230 and the very bottom of bottom member 240.

However, in other embodiments removable cover 110 may obscure only a portion of top member 230 and/or bottom member 240. By way of example, removable cover 110 may couple with top member 230 at a point half of the way up the outside of top member 230. These embodiments may or may not have cut-outs 410 as is necessary per other features of golf bag 100. In yet other embodiments, removable cover 110 may not obscure any significant portion of top member 230 and/or bottom member 240 by coupling with top member 230 at a bottom-most point on top member 230, and a top-most point on bottom member 240. These embodiments also may or may not have cut-outs 410 as is necessary per other features of golf bag 100.

Finally, coupling mechanisms 420 may be provided around at least a portion of the perimeter of removable cover 110. These coupling mechanisms 420 may provide for the coupling of removable cover 110 to itself, or to portions of frame 200, thereby completing a clean covering of frame 200. Coupling mechanisms 420 may be any coupling mechanism known in the art, including buttons, rivet buttons, latches, hook and loop (Velcro®), string ties, buckles, magnets, zippers, etc.

Figure 5:
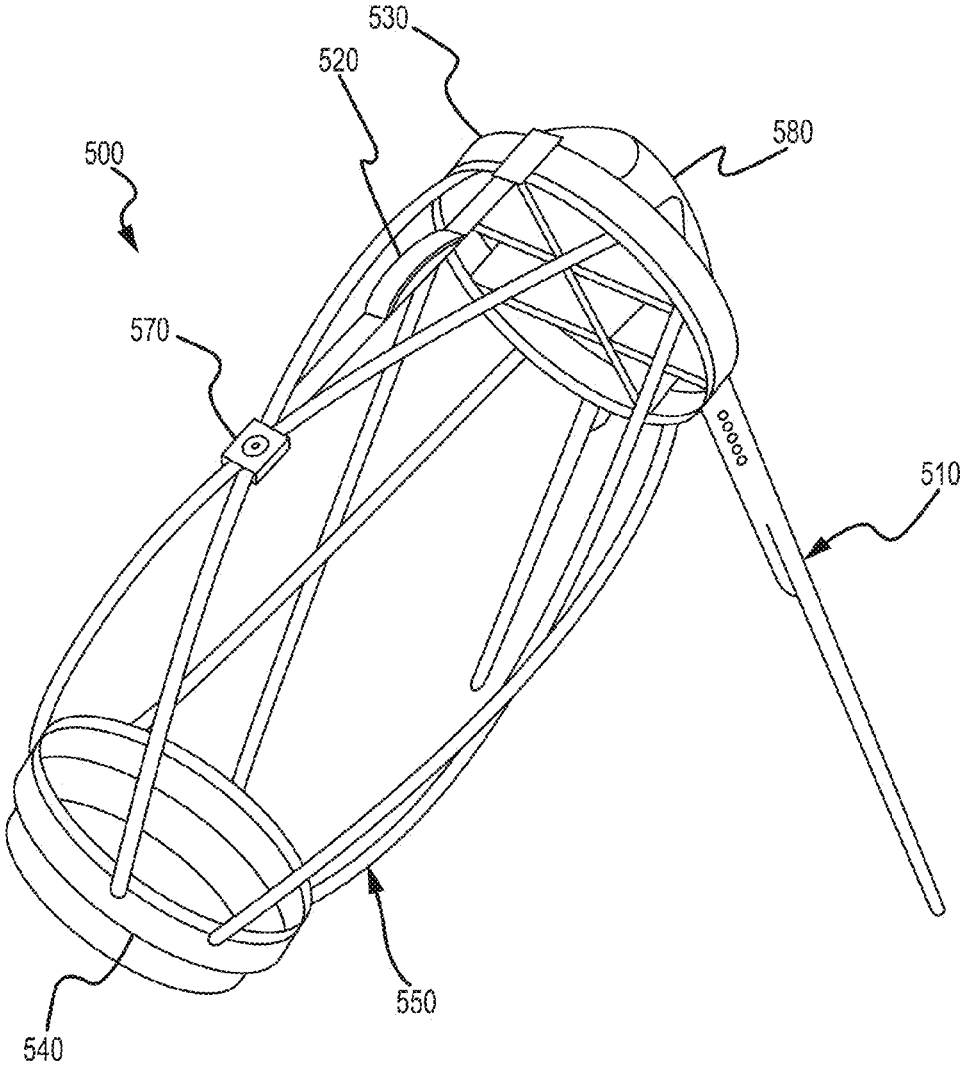
FIG. 5 is an axonometric view of another frame of a golf bag of the invention.

In another embodiment, as provided for by the above disclosure, and which is further described below, another frame 500 is provided as shown in FIG. 5. Frame 500 includes deployable leg stands 510, carrying handle 520, top member 530, bottom member 540, at least diagonal members 550, frame coupling element 570, and club separator 580.

Diagonal members 550 diagonally couple top member 530 with bottom member 540. The six diagonal members 550 may cross each other in pairs as shown. Diagonal members 550 may couple in to cylindrical recesses in top member 530 and bottom member 540. Two of diagonal members 550 cross each other and are coupled together by frame coupling element 570. Diagonal members 550 may bow outwards from the center of frame 500 to push outward on removable cover 110 (see FIG. 1).

In any of the aforementioned embodiments, any number of diagonal members 550 may be present, possibly in pairs of two, with each pair crossing each other between top member 530 and bottom member 540 as shown in FIG. 5. These diagonal members 550 may or may not be hollow, and may have an outer diameter between 5 millimeters to 6 millimeters. Though shown in FIG. 5 as being evenly distributed around the circumference of the bag (120° per pair of diagonal members 550 in the case of three pairs), other distributions are possible. In some embodiments, one, two, or more, vertical members may also be coupled with both top member 530 and bottom member 540 to provide additional support or rigidity to frame 500.

Frame coupling element 570 may be the connection point for the bottom of carrying strap 130 (see FIG. 1) and couple together the two front diagonal members 550. Carrying handle 520 may be coupled to a member extending between, top member 530 and frame coupling element 570. In other embodiments, frame coupling element may only attach to one diagonal member 550. In other embodiments, frame coupling element 570 may not be present, and carrying handle 520, as well as the bottom of the member having carrying strap 130 may attach directly to diagonal member(s) 550. Furthermore, club separator 580 and deployable leg stands 510 may be fixedly coupled with, or integral to, top member 530.

Figure 6:
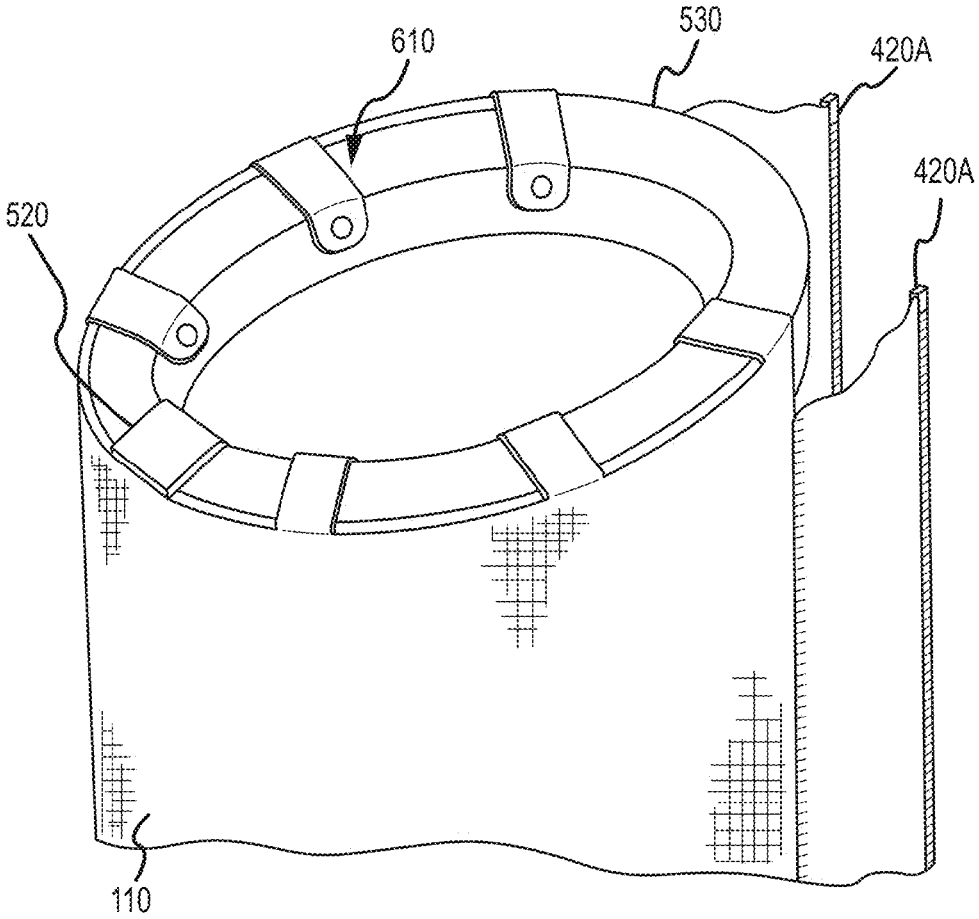
FIG. 6 is a perspective view of a top of a frame with a removable cover attached thereto.

FIG. 6 shows fasteners 610 on removable cover 110 coupled with matching fasteners (hidden) on top member 530. These "snap" buttons, or other coupling mechanism, may allow a user to quickly and easily decouple removable cover 110 from frame 500. Any other type of coupling member or mechanism discussed herein, and in any possible quantity, may also or alternatively be used. Top portion of the member having carrying handle 520 is also seen coupled to top member 530. Finally, in this embodiment, a zipper 420A is shown as the vertical coupling mechanism for removable cover 110. Zippers 420A may allow removable cover to be coupled to itself on the backside of the golf bag, thereby more fully enclosing frame 500. Zippers 420A, or other vertical coupling mechanism, may start/end at the top of frame 500 at or near top member 530, or just below a top portion of a deployable leg stand mechanism located thereat. Likewise, zippers 420A, or other vertical coupling mechanism, may end/start at the bottom of frame 500 at or near bottom member 540, or just above a bottom portion of a deployable leg stand mechanism located thereat. The material of any portion, or the entirety, of removable cover 110 may or may not be flexible in the vertical or horizontal direction, assisting in providing a taut positioning of removal cover 110 over frame 500.

Figure 7:
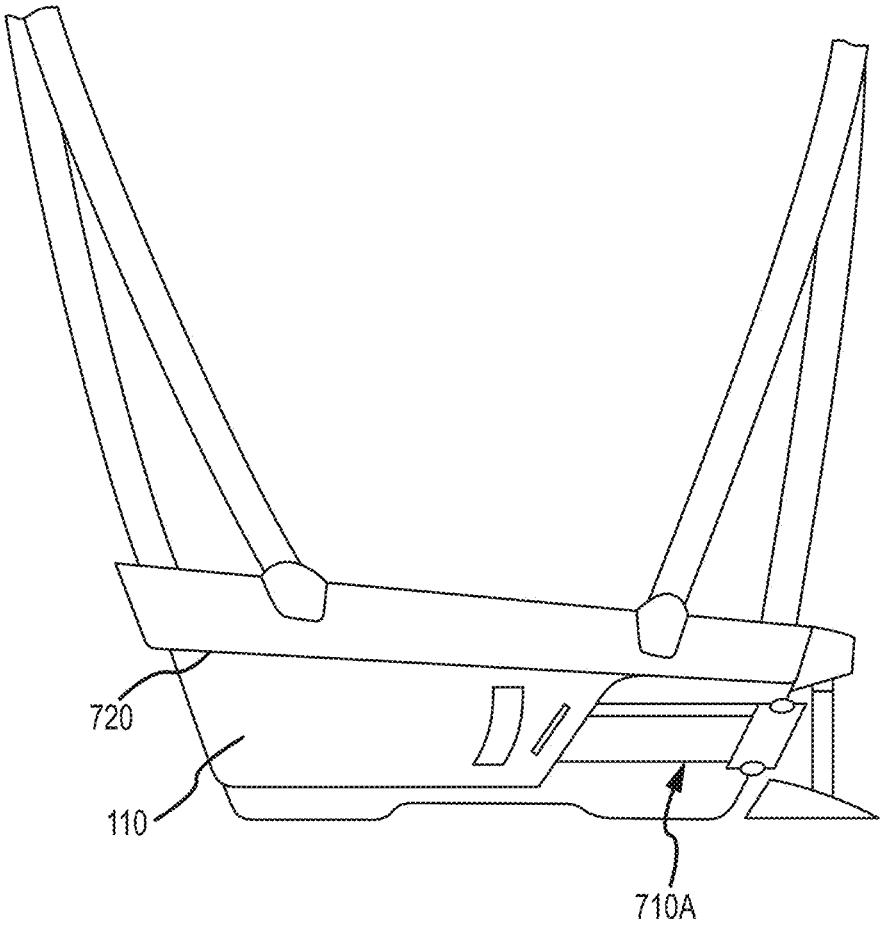
FIG. 7 is side view of a bottom of a frame with a removable cover attached thereto.

FIG. 7 shows a coupling mechanism, or fastener 710A, on the bottom of removable cover 110 which may couple with a mating fastener (not seen) on the other corner of removable cover 110 beneath ledge 720. In this manner, removable cover may be coupled to bottom member 540 such that upward movement of removable cover 110 is at least partially, or totally, inhibited by ledge 720. In some embodiments, fastener 710A may be tightened by a user, possibly via a strap and buckle. The coupling mechanism employed may couple beneath any bottom portion of leg/stand mechanism 730. In other embodiments, any other coupling member or mechanism discussed herein may couple removable cover 110 to bottom member 540.

Figure 8:
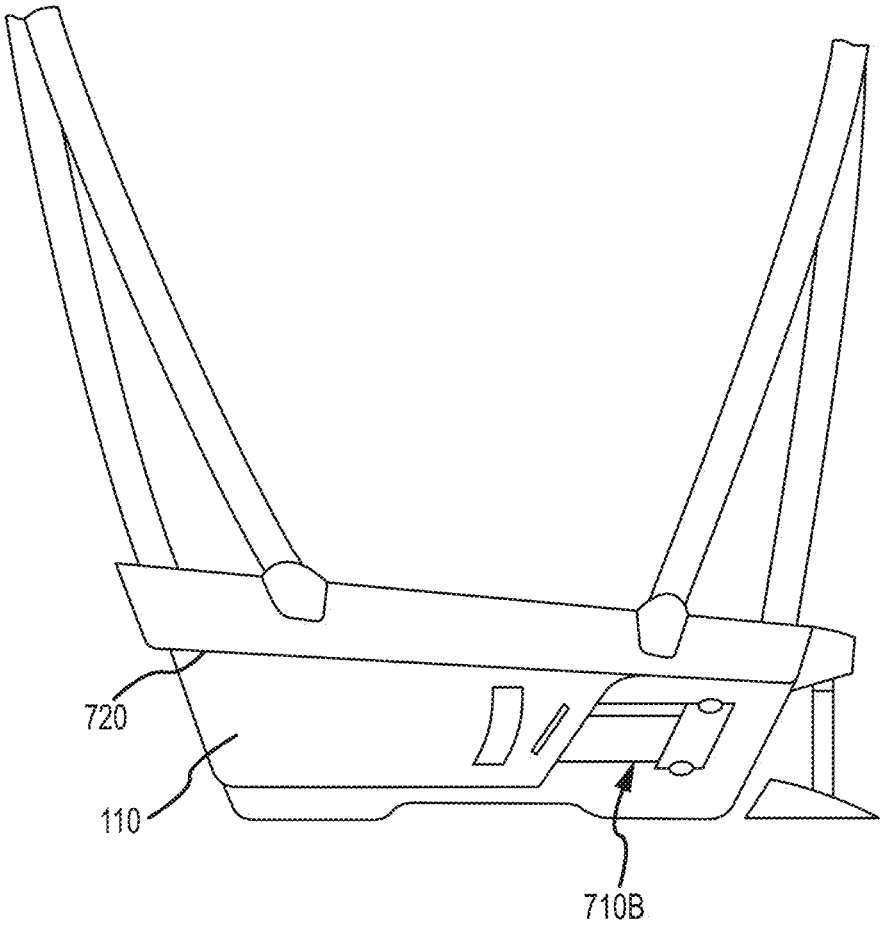
FIG. 8 is a side view of a bottom of a frame with another removable cover attached thereto.

FIG. 8 shows a coupling mechanism, or fastener 710B, on the bottom of removable cover 110 which may couple with a mating fastener on bottom member 540 beneath ledge 720. In this manner, removable cover may be coupled to bottom member 540 such that upward movement of removable cover 110 is at least partially, or totally, inhibited by ledge 720. In some embodiments, fastener 710B may be tightened by a user, possibly via a strap and buckle. The coupling mechanism employed may couple beneath any bottom portion of leg/stand mechanism 730. In other embodiments, any other coupling member or mechanism discussed herein may couple removable cover 110 to bottom member 540.

The invention has now been described in detail for the purposes of clarity and understanding. However, it will be appreciated that certain changes and modifications may be practiced within the scope of the appended claims.

What is claimed is:

1. A golf bag, wherein the golf bag comprises:
a frame, wherein:
the frame comprises:
a bottom member;
a top member;
six diagonal members; and
a frame coupling element;
each of the six diagonal members diagonally couple the bottom member with the top member;
the frame coupling element couples two of the diagonal members; and
a removable cover, wherein:
the removable cover comprises:
a central portion;
a first coupling mechanism; and
a second coupling mechanism;
the first coupling mechanism is coupled with at least a portion of a top of the central portion;
the second coupling mechanism is coupled with at least a portion of a bottom of the central portion;
the first coupling mechanism is reversibly coupled with the top member; and
the second coupling mechanism is reversibly coupled with the bottom member.

2. The golf bag of claim 1, wherein the frame further comprises a carrying handle coupled between the top member and the frame coupling element.

3. The golf bag of claim 1, wherein the golf bag further comprises:
a carrying strap, wherein:
a first portion of the carrying strap is coupled with the top member and a second portion of the carrying strap is reversibly coupled with the frame coupling element.

4. The golf bag of claim 1, wherein:
the first coupling mechanism comprises a first plurality of fasteners;
the top member comprises a second plurality of fasteners; and
the first coupling mechanism being reversibly coupled with the top member comprises the first plurality of fasteners being coupled with the second plurality of fasteners.

5. The golf bag of claim 1, wherein:
the second coupling mechanism comprises a first fastener and a second fastener;
the bottom member defines a ledge, the bottom member having a smaller diameter below the ledge than above the ledge; and
the second coupling mechanism being reversibly coupled with the bottom member comprises the first fastener coupled with the second fastener below the ledge.

6. The golf bag of claim 5, wherein the first fastener coupled with the second fastener causes the removable cover to tighten circumferentially below the ledge.

7. The golf bag of claim 1, wherein:
the central portion comprises a material which is more flexible in a first direction between the top member and the bottom member than a second direction perpendicular to the first direction.

8. The golf bag of claim 1, wherein:
the second coupling mechanism comprises a first fastener and a second fastener; and
the bottom member defines a ledge, the bottom member having a smaller diameter below the ledge than above the ledge; and
the second coupling mechanism being reversibly coupled with the bottom member comprises:
the first fastener coupled with the bottom member below the ledge; and
the second fastener coupled with the bottom member below the ledge.

9. The golf bag of claim 8, wherein the first fastener coupled with the bottom member below the ledge and the second fastener coupled with the bottom member below the ledge causes the removable cover to tighten circumferentially below the ledge.

10. A golf bag, wherein the golf bag comprises:
a frame, wherein the frame comprises:
a top member at a top most portion of the frame; and
a bottom member at a bottom most portion of the frame;
a removable cover, wherein:
the removable cover comprises:
a central portion;
a first coupling member; and
a second coupling member;
the first coupling mechanism is coupled with at least a portion of a top of the central portion;
the second coupling mechanism is coupled with at least a portion of a bottom of the central portion;
the first coupling mechanism is reversibly coupled with a top most portion of the top member; and
the second coupling mechanism is reversibly coupled with the bottom member.

11. The golf bag of claim 10, wherein:
the golf bag further comprises a carrying strap;
the frame further comprises a frame coupling element coupling together two diagonal members which couple the top member with the bottom member; and
a first portion of the carrying strap is coupled with the top member and a second portion of the carrying strap is reversibly coupled with the frame coupling element.

12. The golf bag of claim 11, wherein:

the removable cover defines an aperture; and the second portion of the carrying strap being reversibly coupled with the frame coupling element comprises a coupling through the aperture.

13. The golf bag of claim 10, wherein:

the first coupling member comprises a first plurality of fasteners;

the top member comprises a second plurality of fasteners; and the first coupling member being reversibly coupled with the top member comprises the first plurality of fasteners being coupled with the second plurality of fasteners.

14. The golf bag of claim 10, wherein:

the second coupling mechanism comprises a first fastener and a second fastener;

the bottom member defines a ledge, the bottom member having a smaller diameter below the ledge than above the ledge; and the second coupling mechanism being reversibly coupled with the bottom member comprises the first fastener coupled with the second fastener below the ledge.

15. The golf bag of claim 10, wherein:

the second coupling mechanism comprises a first fastener and a second fastener;

the bottom member defines a ledge, the bottom member having a smaller diameter below the ledge than above the ledge; and the second coupling mechanism being reversibly coupled with the bottom member comprises:

the first fastener coupled with the bottom member below the ledge; and the second fastener coupled with the bottom member below the ledge.

16. A golf bag, wherein the golf bag comprises:

a frame, wherein:

the frame comprises:

a bottom member;

a top member;

six diagonal members; and a frame coupling element;

each of the six diagonal members diagonally couple the bottom member with the top member and diagonally cross at least one other diagonal member;

the frame coupling element couples two of the diagonal members; and a cover, wherein the cover is disposed over the frame.

17. The golf bag of claim 16, wherein the frame coupling element coupling two of the diagonal members comprises:

the frame coupling element coupling two of the diagonal members on an interior side of the frame relative to the cover.

18. The golf bag of claim 16, wherein the golf bag further comprises:

a carrying strap, wherein:

a first portion of the carrying strap is coupled with the top member and a second portion of the carrying strap is reversibly coupled with the frame coupling element.

19. The golf bag of claim 16, wherein the cover being disposed over the frame comprises:

the cover being reversibly coupled with the frame.

20. The golf bag of claim 19, wherein the cover being reversibly coupled with the frame comprises:

the cover being coupled with the top member and the bottom member; and the cover stretched between the top member and the second member.

* * * * *